252-103 AU 157 EX
4/16/85 XR 4,511,487

United States Patent [19]
Prühs et al.

[11] Patent Number: 4,511,487
[45] Date of Patent: Apr. 16, 1985

[54] DISHWASHER DETERGENT PASTE

[75] Inventors: Horst Prühs; Theodor Altenschöpfer, both of Düsseldorf, Fed. Rep. of Germany

[73] Assignee: Henkel Kommanditgesellschaft auf Aktien, Düsseldorf, Fed. Rep. of Germany

[21] Appl. No.: 525,325

[22] Filed: Aug. 22, 1983

[30] Foreign Application Priority Data

Mar. 24, 1983 [DE] Fed. Rep. of Germany ..... 3310684

[51] Int. Cl.[3] ..... C11D 3/08; C11D 17/00; C11D 3/395

[52] U.S. Cl. ..... 252/99; 252/103; 252/135; 252/140; 252/160; 252/173; 252/174.25; 252/DIG. 14; 134/93; 134/94; 134/100; 134/101

[58] Field of Search ..... 252/135, 99, 140, DIG. 14, 252/173, 103, 160, 174.25; 134/93, 94, 100, 101

[56] References Cited

U.S. PATENT DOCUMENTS

| | | | |
|---|---|---|---|
| 4,005,027 | 1/1977 | Hartman | 252/95 |
| 4,071,377 | 1/1978 | Schwuger et al. | 134/29 |
| 4,115,308 | 9/1978 | Guerry | 252/135 |
| 4,116,849 | 9/1978 | Leikhim | 252/135 |
| 4,116,851 | 9/1978 | Rupe et al. | 252/103 |
| 4,411,810 | 10/1983 | Dutton et al. | 252/99 |

FOREIGN PATENT DOCUMENTS 1237199 6/1971 United Kingdom .

*Primary Examiner*—John E. Kittle
*Assistant Examiner*—Mukund J. Shah
*Attorney, Agent, or Firm*—Ernest G. Szoke; Nelson Littell, Jr.; Henry E. Millson, Jr.

[57] ABSTRACT

A detergent paste for use in dishwashers comprised of a pasty, thixotropic cleaning agent with a viscosity of at least 30 Pa.s at 20° C. as determined with a rotational viscosimeter at a spindle speed of 5 revolutions per minute and (A) essentially a mixture of hydrated sodium tripolyphosphate and hydrated sodium metasilicate in the form of sodium tripolyphosphate hexahydrate and sodium metasilicate pentahydrate as finely ground substances having an average particle size of less than 0.3 mm, (B) an optional active chlorine compound and (C) a thickening agent compatible therewith for example foliated silicates of the hectorite type and a method of washing dishes in a dishwasher.

6 Claims, No Drawings

DISHWASHER DETERGENT PASTE

STATE OF THE ART

The detergents used in mechanical dishwashers usually are in the form of powders, granulates, or tablets. The feeding devices in these machines, into which the detergents are filled before washing, are constructed to accommodate solid products and normally consist of closable chambers that open during the main wash cycle to release their contents. A number of disadvantages result from this method of operation. When the detergent is poured in, the user must tap the storage package or the measuring cup to make the powder flow into the feed chamber, which frequently leads to the spilling of relatively large quantities of the powder and/or to contact with the skin. These spilled portions usually are lost for the washing operation since they are siphoned off at the end of the pre-wash cycle, together with the cold pre-wash liquor. Also, if powder gets into the opening mechanism of the feed chamber during filling, the cover may not close completely or the magnetic closure or mechanical/electrical closure used in some constructions may not lock securely enough, so that part or all of the powder seeps out when the loading door of the dishwasher is closed and is again lost for the main wash cycle. Problems can also arise in machines in which the feed chamber is additionally secured with a protective screen and detergents are used that do not have an optimal rate of solution or have become lumped together during standing for an extended time in opened cartons. A detergent that is incompletely dissolved during the wash cycle results in poorer cleaning and impairs the action of the acid rinsing agent. Also, conductivity measurements have shown that readily soluble detergents require a relatively long time—under unfavorable circumstances up to 10 minutes—for complete solution following their release, which means that the operation proceeds for a considerable length of time with a low concentration of detergent. Improvements attempted during recent years concerning the machine, the rinsing-in mechanism, and the detergents, have been directed to improvements in the free flow and faster rate of solution for the always solid detergent. The possibility of using liquid agents has been limited to the acid rinsing product, which is usually filled into a storage container.

The use of liquid detergents rather than powders in dishwashers has not been considered since the widely used feeding devices are not suitable for liquid agents as presently constructed. Also, there has been the expectation that a storage tank comprising an integral part of the machine would warm up considerably during each wash cycle and lead to the decomposition of the source of active chlorine normally included in the detergent.

Copending, commonly assigned U.S. patent application Ser. No. 357,471 filed Mar. 12, 1982 describes an aqueous, thixotropic dishwasher detergent composition which is at room temperature a paste having a viscosity of at least about 30 Pa.s as measured at 20° C. with a rotational viscosimeter at 5 spindle revolutions per minute, the dishwasher detergent composition comprising:

(a) at least one compound with cleaning action or binding capacity for ions causing hardness selected from the group consisting of polyphosphates, aluminosilicates, silicates, hydroxides, and carbonates of sodium or potassium in an amount sufficient to effect cleaning or binding;

(b) an active chlorine compound in an amount sufficient to provide active chlorine to the detergent composition; and (c) a thickener compatible with components (a) and (b) in an amount sufficient to give the desired viscosity.

The agents used in the said application contain as cleaning component (A) inter alia the particularly suitable pentasodium or pentapotassium triphosphates and sodium or potassium silicates characterized by a ratio of $Me_2O$ to $SiO_2$ of from 1:0.5 to 1:3.5 (Me=Na, K) and also mixtures of silicates differing in their composition, for example those in which the ratio of $Me_2O$ to $SiO_2$ is from 1:0.5 to 1:1 with those in which the ratio of $Me_2O$ to $SiO_2$ is from 1:2 to 1:3.5.

In a preferred formulation, therefore, component (A) has the following composition:

3 to 40% by weight of sodium and/or potassium tripolyphosphate, 5 to 30% by weight of sodium and/or potassium silicates, 0 to 25% by weight of finely particulate sodium alumosilicate capable of binding calcium salts, 0 to 20% by weight of sodium and/or potassium carbonate and/or hydroxide, the sodium or potassium silicate preferably consisting of a mixture of metasilicates having a ratio of $Me_2O$ to $SiO_2$ of 1:1 and disilicates or waterglass having a ratio of $Me_2O$ to $SiO_2$ of from 1:2 to 1:3.5, the constituents of this mixture being mixed in a ratio of from 2:1 to 1:10 and, more particularly in a ratio of from 1:1 to 1:5, expressed in each case as anhydrous substance. In the Examples of the said application, sodium tripolyphosphate and anhydrous sodium metasilicate are used in component (A).

OBJECTS OF THE INVENTION

It is an object of this invention to provide a novel dishwasher detergent in paste form.

It is a further object of this invention to provide a dishwasher detergent composition which is a paste at room temperature with a viscosity of at least about 30 Pa.s as measured at 20° C. with a rotational viscometer at 5 spindle revolutions per minute and comprising (a) essentially a mixture of hydrated sodium tripolyphosphate and hydrated sodium metasilicate in the form of sodium tripolyphosphate hexahydrate and sodium metasilicate pentahydrate as finely ground substances having an average particle size of less than 0.3 mm, (b) an optional active chlorine compound; and (c) a thickener compatible with components (a) and (b).

It is another object of the invention to provide a novel method of washing dishes in a dishwasher.

These and other objects and advantages of the invention will become more obvious from the following detailed description.

THE INVENTION

The novel detergent paste of the invention for use in dishwashers is comprised of a pasty, thixotropic cleaning agent with a viscosity of at least 30 Pa.s at 20° C. as determined with a rotational viscosimeter at a spindle speed of 5 revolutions per minutes and (A) essentially a mixture of hydrated sodium tripolyphosphate and hydrated sodium metasilicate in the form of sodium tripolyphosphate hexahydrate and sodium metasilicate pentahydrate as finely ground substances having an average particle size of less than 0.3 mm, (B) an optional active chlorine compound and (C) a thickening agent compatible therewith.

The crux of the invention resides in the use of hydrated sodium tripolyphospate and in the use of hydrated sodium metasilicate in component (A). The hydrated sodium tripolyphosphate used is preferably the hexahydrate completely present in that form and commercially available products which are not completely hydrated to that stage may have to be rehydrated in a separate step. Of the various sodium metasilicate hydrates, it is preferred to use the so-called pentahydrate as in this way, it is possible to obtain pastes particularly white in color which makes them more attractive to the user. In addition, where hydrated metasilicates are used, there is no need to add other alkaline constituents.

Since sodium tripolyphosphate hexahydrate is less readily soluble in water than potassium tripolyphosphate, the use of sodium tripolyphosphate hexahydrate leads through the heterogeneous character of the resulting pastes to a higher viscosity which, in addition, as the so-called high structural viscosity decreases considerably at relatively high spindle speeds and increases considerably at low spindle speeds. The viscosity measurements were carried out using a Brookfield rotational viscosimeter.

The viscosities of the cleaning agents used in accordance with the invention extend up to 850 Pa.s, as measured at 20° C. using a type RTV Brookfield rotational viscosimeter at 5 revolutions per minute.

Component (B) consists of an active chlorine compound, preferably sodium, potassium or lithium hypochlorite. Other suitable active chlorine compounds are chlorinated trisodium-or tripotassium-o-phosphate. Organic chlorine donors such as trichloroisocyanuric acid or alkali metal dichloroisocyanurates and N-chlorinated sulfamides or triazines are less preferred because they are not as stable in storage in the cleaning agents used in accordance with the invention. The chlorine donor is preferably used in such a quantity that the cleaning agent contains from 0.1 to 3.0% by weight and, more particularly, from 0.5 to 2.0% by weight of active chlorine.

It is obvious that the cleaning agents used in accordance with the invention may also be free from chlorine donors. In that case, the dishes to be washed are limited to those soiled with the type on which the active chlorine compound would in any case be ineffectual. The chlorine stability of the agents according to the invention is at least as good as that of the agents described in copending application Ser. No. 357,471.

Natural or synthetic foliated silicates of the hectorite type have again proved to be particularly suitable for component (C). Both the prepared natural hectorites and also the synthetic hectorites may still contain certain impurities which have no adverse effects where the agents are used in accordance with the invention. In the case of the prepared natural hectorites, these impurities are other foliated silicates or small quantities of calcite whereas, in the case of the synthetic hectories, the impurities in question are, for example, sodium carbonate and sodium sulfate. The water-soluble secondary products of the synthesis process do not have to be washed out completely, if at all, which considerably reduces manufacturing costs. When synthetic hectorite is used, it does not even have to be freed from water before production of the cleaning agent. Instead it may be further processed in the form of an aqueous suspension or moist filter cake after most of the water has been separated off by centrifuging or filtration without any need for the cleaning agents used in accordance with the invention to be subjected to further pretreatment.

In general, hectorites are understood to be trioctahedral foliated magnesium silicates corresponding to the following general formula $$[(Li_xMg_{6-x})Si_8O_{20}(OH)_{4-y}F_y]\ x(-)\cdot\frac{x}{n}\ M^{n(+)}$$

in which x has a value of greater than 0 and less than 6, y has a value of from 0 to 4 and n is an integer of from 1 to 3 and M is a cation. The cation M is preferably sodium, in which case n has a value of 1. The water content of an air-dry product is generally from 5 to 10% by weight.

The foliated silicates may be used in the form of fine particles, i.e. the percentage, retained by sieving on a 0.25 mm mesh sieve should amount to less than 5% by weight and preferably to less than 1% by weight. The quantity of foliated silicate to be used is determined primarily by its swellability. In the case of hectorite, the quantity used generally amounts to between 1 and 10% by weight and preferably to between 2 and 6% by weight based on hectorite dried at 105° C.

Nonionic tensides with low foaming capacity, which do not decompose in the presence of active chlorine compounds and if needed, alkali metal hydroxides, are used as optional constituents. The nonionic tensides are preferably ethylene oxide adducts of higher molecular polypropylene glycols with molecular weights from about 900 to 4,000 as well as adducts of ethylene oxide or ethylene oxide and propylene oxide onto higher fatty alcohols such as dodecyl alcohol, palmityl alcohol, stearyl alcohol, oleyl alcohol, or their mixtures, as well as synthetic alcohols with the chain lengths $C_{12}$–$C_{18}$, for example, those prepared by oxosynthesis, and corresponding alkylene oxide adducts of alkyl phenols, preferably nonyl phenol.

Examples of suitable adducts are the adduct of 10 to 30% by weight of ethylene oxide onto a polypropylene glycol of the molar weight 1,750, the adduct of 20 mols of ethylene oxide or of 9 mols of ethylene oxide and 10 mols of propylene oxide onto nonyl phenol, the adduct of 5 to 12 mols of ethylene oxide onto a mixture of fatty alcohols with chain lengths of $C_{12}$–$C_{18}$, including a content of approximately 30% by weight of oleyl alcohol or similar alcohols. These examples are not intended to be limitative. The content of nonionic tensides can amount to up to about 5% by weight, preferably from 0.1 to 1% by weight, based on the total weight of the detergent.

Chlorine- and alkali-resistant dyes and fragrances can also be added to the dishwashing detergents, if desired. Other optional constituents comprise accompanying substances in the active substances used, such as sodium sulfate, sodium chloride, or mineral admixtures of the foliated silicate.

Other usable complexing agents generally comprise nitrogen-free complexing agents resistant against active chlorine, for example, polyvalent phosphonic acids such as methylene diphosphonic acid, or polyvalent phosphonocarboxylic acids such as 1,1-diphosphonopropan-1,2-dicarboxylic acid, 1-phosphonopropan-1,2,3-tricarboxylic acid, or 2-phosphonobutan-2,3,4-tricarboxylic acid or their sodium or potassium salts. Additional suitable complexing agents comprise the polycarboxylic acids resistant to active chlorine and their salts.

The detergents can be filled into the storage containers immediately after their preparation. The maximal viscosity value is generally reached after standing for a period of from two to ten days. A temporary liquefaction is produced by vigorous shaking or pressing, but the gel phase is restored only a few seconds after the mechanical strain is discontinued, that is, the detergent transferred to the holding chamber in the dishwasher congeals with sufficient rapidity that it does not flow out after shutting of the closing flap of the holding chamber or the loading door in the dishwasher.

The detergents to be used according to the invention are characterized by a strong cleaning action and especially by a high storage stability. The loss of active chlorine during a standing time of six months at 25° C. has been found to be approximately the same as that of the commercial detergent granulates stored dry. Also, a surprising observation was that temperatures of about 60° C. were not detrimental to the storage stability or the content of active chlorine. This became apparent during an experiment in which a holding chamber adequate for ten wash cycles, together with a connected metering pump, was built into the loading door of a conventional dishwasher, and the metering of the detergent was controlled by programming. During the experimental period of five days (2 wash cycles per day), the detergent paste, which was warmed up repeatedly due to heat transfer, did not sustain a loss of active chlorine significant enough to impair the cleaning result.

The observation of the rinsing-in behavior by conductivity measurements showed that the detergent was completely rinsed down within 1 to 4 minutes after opening the holding chamber and was completely dissolved or suspended within 2 to 5 minutes. This operation usually takes 7 to 15 minutes, in unfavorable cases up to 20 minutes, with powdered to granulated detergents.

A special advantage, furthermore, is the fact that the substances can be metered with considerably greater ease and accuracy than regular granular or powdered detergents, which often are partially spilled during filling into the relatively small holding chambers due to the usually necessary shaking of the storage container or measuring cup. The danger of impairing the functioning of the opening mechanism due to spilled detergent and that, especially in chambers with magnetic closure, the contact is not sufficiently tight so that the flap opens too soon, is eliminated with the use of the products according to the invention.

Bleaching pastes containing two different types of clay, among them hectorite, as thickeners as well as active chlorine compounds were known from British Pat. No. 1,237,199, incorporated herein by reference, where the products are applied for use to the goods to be bleached and remain on the the place of contact for some time due to their gel structure and thus have a particularly sustained action. However, it could not be discerned from this patent that products such as those described herein would be suitable as detergents in dishwashers. Furthermore, scouring pastes containing anionic, nonionic, zwitterionic, or ampholytic tensides, that is, mainly those with active foam, as well as bleaches with active chlorine, clay-like builders, including hectorite, and, as main constituent, a special abrasive component, are described in U.S. Pat. Nos. 4,051,055 and 4,051,056 as well as in German published applications (DE-OS) Nos. 25 39 733 and 27 39 776, all of which are incorporated herein by reference. The thickener is used mainly to prevent the settling of the abrasive, which has a low specific weight. The idea of using low-foaming detergents that are free of abrasives instead of conventional powdered or granulated products in dishwashers is completely foreign to these publications, particularly since the purpose is entirely different.

In the following examples there are described several preferred embodiments to illustrate the invention. However, it is to be understood that the invention is not intended to be limited to the specific embodiments.

EXAMPLES

A lithium-containing foliated silicate of the hectorite type was used as thickener and the product referred to hereinafter as "Hectorite III" is the commercially available product Laponite RD ® manufactured by Laporte Ind. Ltd. The water content of the product (drying loss at 105° C.) amounted to 7–8% by weight and sieve analysis produced a residue of less than 1% by weight on a DIN 0.25 mm mesh sieve. The viscosity of a 5% by weight aqueous gel measured at 20° C. using a Brookfield rotational viscosimeter (spindle speed 5. r.p.m.) amounted to 108 Pa.s.

EXAMPLE 1

A paste-form cleaning agent containing, in % by weight 22% of sodium tripolyphosphate hexahydrate with an average particle size below 0.3 mm, 31% of sodium metasilicate pentahydrate with an average particle size below 0.3 mm, 10% of chlorine bleach liquor with an active chlorine content 13%, 3% of Hectorite III (Laponite RD ®) and 34% of water was prepared by stirring the Hectorite III into the water which had been heated to around 40° C. After the foliated silicate had swollen and had formed a clear viscous gel with water, which took about 10 minutes, the gel thus formed was cooled to room temperature and the chlorine bleach liquor, the finely ground sodium metasilicate pentahydrate and the finely ground sodium tripolyphosphate hexahydrate were added with vigorous stirring. After a homogeneous cream-like paste had formed, it was left to ripen for 24 hours and then was thoroughly stirred again. After storage for 10 days at room temperature, the viscosity of the paste obtained amounted to 304 Pa.s, as measured at 20° C. using a type RTV Brookfield rotational viscosimeter (spindle speed 5 r.p.m.). After 2 months, the loss of active chlorine amounted to only 15%.

EXAMPLE 2

A paste was prepared as in Example 1 which contained 25% of sodium tripolyphosphate hexahydrate, 36% of sodium metasilicate pentahydrate, 5% of chlorine bleach liquor with an active chlorine content 13%, 3% of Hectorite III (Laponite RD ®) and 31% of water. After storage for 10 days at room temperature, the viscosity of the paste obtained amounted to 480 Pa.s, as measured at 20° C. using the type RTV Brookfield rotational viscosimeter (spindle speed 5 r.p.m.). After storage for 2 months at room temperature, the loss of active chlorine amounted to 12%.

EXAMPLE 3

A paste was prepared as in Example 1 containing 23% of sodium tripolyphosphate hexahydrate, 33% of sodium metasilicate pentahydrate, 5% of chlorine bleach liquor with an active chlorine content 13%, 4% of Hectorite III (Laponite RD®) and 35% of water. After storage for 10 days at 20° C. the viscosity, measured in the same way as in Example 1, amounted to 696 Pa.s. After storage for 2 months at room temperature, the loss of active chlorine amounted to 10%.

Various modifications of the compositions and method of the invention may be made without departing from the spirit or scope thereof and it should be understood that the invention is intended to be limited only as defined in the appended claims.

What we claim is:

1. A detergent paste for use in dishwashers comprising of a pasty, thixotropic cleaning agent with a viscosity of from 30 Pa.s. to 850 Pa.s. at 20° C. as determined with a rotational viscosimeter at a spindle speed of 5 revolutions per minute consisting essentially of (A) a mixture of from 3% to 40% by weight of sodium tripolyphosphate hexahydrate and from 5% to 30% on an anhydrous basis of sodium metasilicate pentahydrate, both having an average particle size of less than 0.3 mm., (B) from 0.1% to 3.0% by weight of active chlorine of an alkali metal hypochlorite, (C) from about 1% to 10% by weight of a swellable foliated silicate of the hectorite type having fine particles with less than 1% by weight retained on a 0.25 mm mesh seive and being capable of forming a thixotropic gel in water, (D) from 0 to 5% by weight of nonionic tensides which have a low foaming capacity, do not decompose in the presence of active chlorine compounds and are alkali stable, and (E) sufficient water to give the desired viscosity, all based upon the total weight of the detergent composition.

2. The composition of claim 1 wherein component (B) is sodium hypochlorite and the active chlorine content of the composition is from about 0.5 to 2.0% by weight, based upon the total weight of the detergent composition.

3. The composition of claim 1 wherein component (C) is present in an amount of from about 2 to 6% by weight, based upon the total weight of the detergent composition.

4. In the process of washing soiled dishes in an automatic dishwasher comprising subjecting dirty dishes and utensils to the optional action of a prewash forcefully projecting an aqueous solution on the surface of said dirty dishes and utensils and then subjecting said dirty dishes and utensils to the action of a wash forcefully projecting an aqueous solution containing a detergent composition on the surface of said dirty dishes and utensils, said detergent composition being released into said wash only, the improvement consisting essentially of employing as said detergent composition a pasty, thixotropic cleaning agent with a viscosity of from 30 Pa.s. to 850 Pa.s. at 20° C. as determined with a rotational viscosimeter at a spindle speed of 5 revolutions per minute consisting essentially of (A) a mixture of from 3% to 40% by weight of sodium tripolyphosphate hexahydrate and from 5% to 30% on an anhydrous basis of sodium metasilicate pentahydrate, both having an average particle size of less than 0.3 mm., (B) from 0.1% to 3.0% by weight of active chlorine of an akali metal hypochlorite, (C) from about 1% to 10% by weight of a swellable foliated silicate of the hectorite type having fine particles with less than 1% by weight retained on a 0.25 mm mesh seive and being capable of forming a thixotropic gel in water, (D) from 0% to 5% by weight of nonionic tensides which have a low foaming capacity, do not decompose in the presence of active chlorine compounds and are alkali stable, and (E) sufficient water to give the desired viscosity, all based upon the total weight of the detergent composition.

5. The process of claim 4 wherein component (B) is sodium hypochlorite and the active chlorine content of the composition is from about 0.5% to 2.0% by weight, based upon the total weight of the detergent composition.

6. The process of claim 4 wherein component (C) is present in an amount of from about 2% to 6% by weight, based upon the total weight of the detergent composition.

* * * * *